US006521701B2

(12) United States Patent
Egraz et al.

(10) Patent No.: US 6,521,701 B2
(45) **Date of Patent: *Feb. 18, 2003**

(54) WATER-RETAINING AND OPTICAL-BRIGHTENER-ACTIVATING POLYMER COMPOSITION, PAPER COATING COLORS AND SHEETS OF COATED PAPER THUS OBTAINED

(75) Inventors: Jean-Bernard Egraz, Ecully (FR); Georges Ravet, Saint-Genis-Les-Ollieres (FR); Jean-Marc Suau, Lucenay (FR); Isabelle Capra-Ogier, Frans (FR); Henri Grondin, Sathonay Village (FR)

(73) Assignee: Coatex S.A.S., Genay (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/900,050

(22) Filed: Jul. 9, 2001

(65) Prior Publication Data

US 2002/0004550 A1 Jan. 10, 2002

Related U.S. Application Data

(63) Continuation of application No. 09/438,045, filed on Nov. 10, 1999, now Pat. No. 6,297,317.

(30) Foreign Application Priority Data

Nov. 10, 1998 (FR) ..... 98 14299

(51) Int. Cl.[7] ..... C08L 29/04; C08K 3/18; C08K 3/36; B32B 23/08; B32B 27/10

(52) U.S. Cl. ..... 524/803; 524/425; 524/431; 524/444; 524/503; 428/425.1; 428/511

(58) Field of Search ..... 524/803, 425, 524/431, 444, 503; 428/425.1, 511

(56) References Cited

U.S. PATENT DOCUMENTS

| | | | |
|---|---|---|---|
| 3,687,884 A | | 8/1972 | Huang |
| 3,793,244 A | | 2/1974 | Megee et al. |
| 4,474,919 A | | 10/1984 | Polatajko-Lobos et al. |
| 4,775,420 A | | 10/1988 | Gonnet et al. |
| 4,780,500 A | | 10/1988 | Sinka et al. |
| 5,231,145 A | | 7/1993 | Brueckmann et al. |
| 5,240,771 A | | 8/1993 | Brueckmann et al. |
| 5,760,154 A | | 6/1998 | Krause et al. |
| 6,008,289 A | | 12/1999 | Koenig et al. |
| 6,297,317 B1 | * | 10/2001 | Egraz et al. |

FOREIGN PATENT DOCUMENTS

| | | |
|---|---|---|
| EP | 0 509 878 A1 | 10/1992 |
| EP | 0 737 728 A | 10/1996 |
| GB | 1 111 954 A | 1/1968 |
| GB | 1271282 | 4/1972 |
| GB | 1 467 127 A | 3/1977 |
| GB | 1 467 127 | 3/1977 |
| JP | 56 101996 A | 8/1981 |

* cited by examiner

*Primary Examiner*—Tae H. Yoon
(74) *Attorney, Agent, or Firm*—Oblon, Spivak, McClelland, Maier & Neustadt, P.C.

(57) ABSTRACT

A stable aqueous liquid polymer composition, which comprises:

(i) at least one polyvinyl alcohol (PVA) which has an Ostwald viscosity less than 5 mPa·s corresponding to a degree of polymerization less than 600 and a molar percentage of hydrolysis ranging from 70 to 100 measured from the ester value (DIN 53401), corresponding to a molar percentage of vinyl acetate units from 30 to 0, and (ii) at least one water-soluble polymer at neutral or alkaline pH, the composition controlling the activation of optical brighteners, water retention and viscosities of paper coating colors.

17 Claims, 1 Drawing Sheet

WATER-RETAINING AND OPTICAL-BRIGHTENER-ACTIVATING POLYMER COMPOSITION, PAPER COATING COLORS AND SHEETS OF COATED PAPER THUS OBTAINED

This is a continuation of U.S. application Ser. No. 09/438,045 filed on Nov. 10, 1999, now U.S. Pat. No. 6,297,317.

BACKGROUND OF THE INVENTION

1. Field of the Invention

The present invention concerns the technical sector of coating sheets of paper.

2. Description of the Background

In techniques for coating paper, cardboard or the like, a coating composition is known which may contain one or several inorganic fillers, one or several binders and various additives. The coating composition is then deposited on a support surface(s). Among these additives, the water-retaining agents are included, which are not to be confused with agents retaining fines or filler on wire.

The goal of coating is to improve certain physical and optical characteristics of paper, such as for example, its gloss, its brightness, its opacity, its capability for ink printing, its "smoothness" and other properties of great commercial importance.

A composition for coating paper is generally formed from a filler which may comprise one or several pigments, one or several polymer binders and various additives such as, especially, a lubricant such as calcium stearate, a wax, or a fatty acid ester, and possibly antifoaming agents, and the like, all of which is well-known to the person skilled in the art.

After deposition on the support, the coating color has a natural tendency to transfer onto the support all or part of the water and water-soluble material that it contains. It is necessary to control a too rapid migration which would harm the physical and optical characteristics of the coat. Therefore, retention of water in the composition or coating color is sought. Also, the water retention must be controlled to avoid a change in the rheology of the coating slip unused and recycled in the coating procedure.

Natural or synthetic water-retaining agents are usually employed such as carboxymethylcellulose (CMC), starch, polyvinyl alcohols (PVA) or even latex or emulsions of highly carboxylated polymers or polycarboxylates, for example, of the polyacrylate type. Such products are described, for example, in EP 0 509 878.

A specific class of retention agents is named as alkali-swellable polymers, and is described in the above-mentioned EP patent, and in U.S. Pat. No. 4,780,500 which will be explained below.

It is naturally essential that the various additives not degrade the other properties of the paper, such as its brightness, its opacity, its mechanical resistance, and the like.

The principal important optical characteristics of the paper are, among others, its opacity, its gloss and its brightness, particularly for printed supports.

In order to improve the brightness of a paper, additives called "optical brighteners" are included in the coating composition, which reinforce the brightness effect of the sheet.

These optical brighteners are in a general and not limiting manner of the type that include in their molecule the stilbene component substituted by diamines and sulfonic groups. These brighteners convert part of the invisible UV radiation into radiation of the visible spectra, generally in the blue to violet range.

A nonlimiting example of a stilbene disulfonic acid derivative used as optical brightener is the product "Tinopal™ (SPP Z or ABP Z or SK)" marketed by the Ciba Company.

Another nonlimiting example of a known optical brightener is the product Blankophor™ (P or BPN)" marketed by the Bayer Company.

Usually the effectiveness of these products depends on their activation. "Activation" is understood here to mean the presence of a co-product that will allow the brightening effect to be revealed and principally to be amplified. And yet, it is known that certain water-retaining agents do not activate optical brighteners.

Moreover, it is known that certain products, i.e., the polyvinyl alcohols or CMC, have limited use because of the high viscosities they develop in coating colors in conjunction with their effectiveness for water retention. Thus, the papermaker is left with two properties that are eminently desirable to reinforce, but which most of the time are antagonists to each other.

For at least a decade, optimization of the effect has been sought with modem water-retention agents, such as thickening polymers, and that of activators of optical brighteners and especially PVA and other additives.

In EP 0 509 878, compositions are disclosed which "can be totally free of synthetic or natural thickeners," (page 2, line 52), which clearly reveals the disadvantages of these compositions in use.

U.S. Pat. No. 4,780,500 describes water-retention agents formed essentially of the acrylic acid monomer and secondarily of itaconic acid monomer, with molecular weight of 100,000–800,000. Neither of these two documents mentions the problem posed by the optical brighteners.

GB 1,467,127 mentions the possible use of PVA as binder in coating compositions, in the same amount as starch, casein, and the like. It mentions the possible presence of optical brighteners (page 2, line 10) but without posing the problem of their activation compared with water retention.

U.S. Pat. No. 3,793,244 describes water-retaining terpolymers of styrene, butadiene and itaconic acid and does not mention PVA.

GB 1,271,282 describes a mixture of latexes, one of which contains a high proportion of styrene. This mixture of latexes promotes water retention. However, no portion of the disclosure discloses the presence of PVA.

U.S. Pat. No. 3,687,884 describes a latex with a vinyl acetate/acrylic acid grafting.

U.S. Pat. No. 5,231,145 and U.S. Pat. No. 5,240,771 teach that it is possible, by grafting, to increase the amounts of PVA in the presence of copolymers with the condition that this copolymer is prepared by polymerizing it in the presence of PVA. The references point out, on the other hand, that simple mixing of this polymer with PVA does not enable a stable composition to be obtained. A need continues to exist for an polymer composition of improved water-retaining and optical brightener-activating characteristics for paper coating colors.

SUMMARY OF THE INVENTION

Accordingly, one object of the present invention is to provide a composition, which is for use in the preparation of paper coating colors, which exhibits improved water-retaining and optical brightening properties.

Briefly, this object and other objects of the present invention as hereinafter will become more readily apparent can be attained by a stable aqueous liquid polymer composition, which comprises:

(i) at least one polyvinyl alcohol (PVA) which has an Ostwald viscosity less than 5 mPa·s corresponding to a degree of polymerization less than 600 and a molar percentage of hydrolysis ranging from 70 to 100 measured from the ester value (DIN 53401), corresponding to a molar percentage of vinyl acetate units from 30 to 0, and (ii) at least one water-soluble polymer at neutral or alkaline pH, said composition controlling the activation of optical brighteners, water retention and viscosities of paper coating colors.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
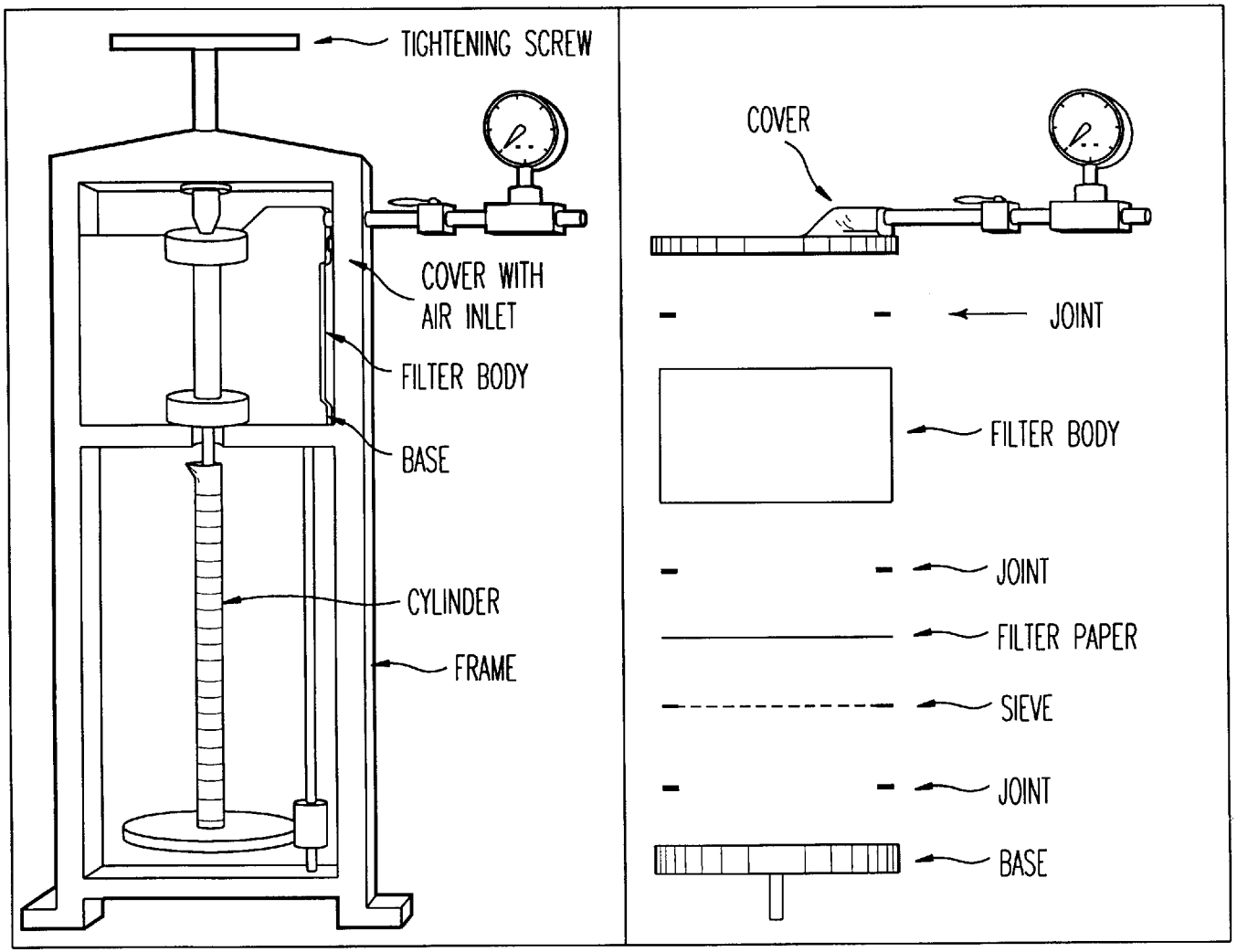
FIG. 1 is a depiction of the filter press discussed in detail in Test 16.

It has now been discovered that, in contrast to the teachings of recent patents such as above-mentioned EP 0 509 878, it is possible to use certain specially selected PVAs in combination with one or several water-retention agents, such as aqueous liquid compositions, which optimize at the same time the function of water retention, which activates optical brighteners, and which controls the viscosity of coating colors, and accomplishing this without degrading the water-retention property as would have been expected. Furthermore, it has been found that the aqueous liquid polymer composition is stable; that is, it remains homogeneous for several days after storage without agitation at room temperature, this stability being a required condition for transport, use and marketing of the composition.

The present invention also permits control of the rheology of the coating colors, that is, of choosing the viscosities of the medium according to the requirements of the application.

Without wanting to be bound by any theory, it is considered that the criteria for the selection of a PVA of the invention must be to ensure the compatibility and stability with the retention agent.

According to the invention, a specific PVA is used which is defined as having:

a viscosity lower than 5 mPa·s, preferably from 2 mPa·s to 4 mPa·s measured according to the standard described below, which corresponds to a degree of polymerization less than 600, preferably from 250 to 500, and a molar percentage of hydrolysis ranging from 70 to 100, preferably from 80 to 90 which corresponds to the molar percentage of vinyl acetate units ranging from 30 to 0, preferably from 20 to 10 measured from the ester value (DIN 53401).

According to a preferred method of execution, the polymer composition or polymeric composition contains a percentage of PVA greater than 20 wt. %, preferably greater than 50 wt. %.

The viscosity of the PVA is determined with the aid of an Ostwald viscometer, apparatus No. 4080 from Prolabo, in which the capillary tube has a length of 100 mm and a reservoir with a capacity of 10 mL.

In order to begin a procedure, a 4% aqueous solution is prepared. To do this an amount of PVA weighed to within 1 mg is introduced into a 60 mL stoppered flask, corresponding to 2.015 g for PVA with 1% moisture, 2.128 g for PVA with 2% moisture, 2.151 g for PVA with 3% moisture, or 2.174 g for PVA with 4% moisture. Then 50 mL distilled water are added, measured accurately with a pipette. It is stoppered and agitated immediately with a heating magnetic stirrer.

The solution for which the viscosity is to be determined must be free of insoluble material capable of modifying the spreading conditions of the fluid in the capillary tube of the viscometer. Therefore, it may be necessary to filter or centrifuge the solution. to When the 4% solution is thus prepared, the viscosity measurement is conducted with the aid of the above-mentioned viscometer immersed in a temperature-controlled bath at 20° C.+/−0.05° C.

Through the remainder of the text the viscosity determined by the method will be indicated as Ostwald viscosity.

An aspect of the invention also is a water-retaining, optical-brightener-activating, aqueous liquid polymer composition containing at least one PVA (polyvinyl alcohol) and at least one water-soluble polymer at neutral or alkaline pH, wherein the water-soluble polymer is a copolymer in dispersion with more than 20 wt. % (20–75%) of monomers having acid groups and more particularly carboxylic groups.

The copolymer in dispersion may be selected from copolymers formed from at least one of the monomers having an acid function such as acrylic and/or methacrylic, itaconic, citraconic, crotonic, fumaric, maleic, isocrotonic, mesaconic, sinapic, undecylenic, angelic acid, and/or their respective anhydrides and/or the hemiesters of diacids, acrylamidomethylpropanesulfonic acid, the acid phosphates or sulfates of acrylates and methacrylates of ethylene glycol, propylene glycol, butylene glycol, polyethylene glycol, polypropylene glycol and polybutylene glycol or others.

The monomer(s) without an acid group may be selected in a nonlimiting way from the derivatives of the above-mentioned acids, such as especially the methyl, ethyl, butyl and 2-ethylhexyl acrylates or methacrylates, and acrylnitrile, methacrylonitrile, acrylamide, methacrylamide, n-methylolacrylamide, and vinyl and/or styrene monomers such as, for example, vinyl acetate, styrene, methylstyrene, diisobutylene, divinylbenzene, methylvinyl ether and vinylcaprolactone and their mixtures. The monomers may also be selected from oxyalkylated monomers with ethylenic unsaturation terminated by a straight-chain or branched chain, such as straight-chain or branched alkyl, aryl, alkylaryl, arylalkyl groups with 1–50 carbon atoms and especially the di-, tri- and tetrastyrylphenol, nonylphenol groups and others.

Suitable monomers without acid groups also include those monomers having at least two ethylenic sites of unsaturation such as especially, an in a nonlimiting way, the group formed by ethylene glycol dimethyacrylate, trimethylolpropane triacrylate, allyl acrylate, methylene-bis-acrylamide, methylenebismethacrylamide, tetrallyloxyethane, triallylcyanurate, allyl ethers obtained from polyols such as pentaerythritol, sorbitol, sucrose and others.

An aspect of the invention is also that the water-soluble polymer component of the water-retaining, optical-brightener-activating stable aqueous liquid polymer composition containing at least one PVA (polyvinyl alcohol) and at least one water-soluble polymer at neutral or alkaline pH, is a water-soluble polyurethane. In another aspect of this composition is that the water-soluble polymer is a homopolymer or copolymer of a carboxylic acid employed in completely acid form and in solution in water.

Still another aspect of the invention concerns the aqueous suspensions or slurries of inorganic fillers containing the stable aqueous liquid polymer composition of the invention.

Suitable inorganic fillers include the natural calcium carbonates such as chalk, calcite, marble and even synthetic calcium carbonates, dolomites, kaolins, talc, titanium dioxide, satin white, mica, calcined clay, aluminum hydroxide, calcium sulfate and their mixtures.

Customarily, the coating colors are prepared by one of skill in the art by mixing in water aqueous suspensions of inorganic fillers, one or several binders of natural or synthetic origin such as for example, casein, starch, caraboxymethylcellulose, polyvinyl alcohols or even a latex of the styrene-butadiene or styrene-acrylate type or even acrylic or vinyl latexes, or others. As is known, the coating colors may also contain a conventional additive such as a rheology modifier, an organic filler, an antifoaming agent, an optical brightener, a biocidal agent, a lubricating agent, an alkaline hydroxide or the like.

According to the invention, a paper coating color containing one or several fillers, one or several polymer binders, water-retainers, pigments, optical brighteners, and various other papermaking additives are provided in which the water retention, the activation of the optical brighteners and the viscosities of coating colors are controlled by the polymer composition of the invention, containing at least one polyvinyl alcohol (PVA) and at least one water-soluble polymer at neutral or alkaline pH.

Having now generally described the invention, a further understanding can be obtained by reference to certain specific examples which are provided herein for purpose of illustration only and are not intended to be limiting unless otherwise specified.

EXAMPLES

Example I

This example shows the comparison of the effectiveness of known optical-brightener activators such as CMC or some PVA with the effectiveness of the activating compositions of the invention.

Test No. 1

For this test, which illustrates the prior art, the following coating color is prepared by mixing:

- 100 parts, expressed as dry matter, of an aqueous suspension of calcium carbonate, marketed by Omya under the name "Hydrocarb™ CC",
- 12 parts, expressed as dry matter, of a styrene-acrylic latex marketed by BASF under the name "Acronal™ S360D",
- 0.5 part, expressed as dry matter, of a solution of PVA marketed under the name "Mowiol™ 3/83" by Clariant,
- 0.5 part, expressed as dry matter, of a carboxymethylcellulose (CMC) marketed under the name "Finnfix™ 10" by Metsä Serla,
- 1 part expressed as is, of an optical brightener marketed by Bayer under the name "Blankophor™ P".

The content of dry matter is on the order of 64% and the pH is on the order of 8–9 by adjusting the pH of the coating color with an aqueous sodium hydroxide solution.

Test No. 2

For this test, which illustrates the prior art, the following coating color is prepared by mixing:

- 100 parts, expressed as dry matter, of an aqueous suspension of calcium carbonate, marketed by Omya under the name "Hydrocarb™ CC",
- 12 parts, expressed as dry matter, of a styrene-acrylic latex marketed by BASF under the name "Acronal™ S360D",
- 0.5 part, expressed as dry matter, of a solution of PVA marketed under the name "Mowiol™6/98" by Clariant,
- 0.5 part, expressed as dry matter, of a carboxymethylcellulose (CMC) marketed under the name "Finnfix™ 10" by Metsä Serla,
- 1 part, expressed as is, of an optical brightener marketed by Bayer under the name "Blankophor™ P"

The content of dry matter is on the order of 64% and the pH is on the order of 8–9 by adjusting the pH of the coating color with an aqueous sodium hydroxide solution.

Test No. 3

For this test, which illustrates the prior art, the following coating color is prepared by mixing:

- 100 parts, expressed as dry matter, of an aqueous suspension of calcium carbonate, marketed by Omya under the name "Hydrocarb™ CC",
- 12 parts, expressed as dry matter, of a styrene-acrylic latex marketed by BASF under the name "Acronat™S360D", p1 1 part, expressed as dry matter, of a carboxymethylcellulose (CMC) marketed under the name "Finnfix™ 10" by Metsä Serla,
- 1 part, expressed as is, of an optical brightener marketed by Bayer under the name "Blankophor™ P", The content of dry matter is on the order of 64% and the pH is on the order of 8–9 by adjusting the pH of the slip with an aqueous solution of sodium hydroxide.

Test No. 4

For this test, which illustrates the prior art, the following coating color is prepared by mixing:

- 100 parts, expressed as dry matter, of an aqueous suspension of calcium carbonate, marketed by Omya under the name "Hydrocarb™ CC",
- 12 parts, expressed as dry matter, of a styrene-acrylic latex marketed by BASF under the name "Acronal™ S360D",
- 1 part, expressed as dry matter, of a solution of PVA marketed under the name "Mowiol™ 3/83" by Clariant,
- 1 part, expressed as is, of an optical brightener marketed by Bayer under the name "Blankophor™ P", The content of dry matter is on the order of 64% and the pH is on the order of 8–9 by adjusting the pH of the coating color with an aqueous sodium hydroxide solution.

Test No. 5

For this test, which illustrates the prior art, the following coating color is prepared by mixing:

- 100 parts, expressed as dry matter, of an aqueous suspension of calcium carbonate, marketed by Omya under the name "Hydrocarb™ CC",
- 12 parts, expressed as dry matter, of a styrene-acrylic latex marketed by BASF under the name "Acronal™ S360D",
- 1 part, expressed as dry matter, of a copolymer in dispersion of the prior art formed from 37 wt % of methacrylic acid and 63 wt. % of ethyl acrylate and called product No. 1

1 part, expressed as is, of an optical brightener marketed by Bayer under the name "Blankophor™P"

The content of dry matter is on the order of 64% and the pH is on the order of 8–9 by adjusting the pH of the coating color with an aqueous sodium hydroxide solution.

For tests of the invention (Test Nos. 6–13) the coating colors of the invention are prepared by mixing:

100 parts, expressed as dry matter, of an aqueous suspension of calcium carbonate, marketed by Omya under the name "Hydrocarb™ CC", 12 parts, expressed as dry matter, of a styrene-acrylic latex marketed by BASF under the name "Acronal™ S360D", 1 part, expressed in dry matter, of a polymer composition of the invention, 1 part, expressed as is, of an optical brightener marketed by Bayer under the name "Blankophor™ P", The content of dry matter is on the order of 64% and the pH is on the order of 8–9 by adjusting the pH of the coating color with an aqueous sodium hydroxide solution.

The optical-brightener-activating and water-retaining polymer composition of the invention is:

Test No. 6

A polymer composition of the invention formed from 70 wt. % of a PVA with Ostwald viscosity equal to 3.5 mPa·s and a molar percentage of hydrolysis equal to 87.5 measured from the ester value (DIN 53401) and 30 wt. % of a copolymer composed of 39 wt. % methacrylic acid, 55 wt. % ethyl acrylate and 6 wt. % of a precondensate of ethylene glycol methacrylate and of toluene diisocyanate condensed on nonylphenol with 50 ethylene oxide units.

The product of the invention is called product No. 2 in the remainder of the application.

Test No. 7

A polymer composition of the invention is formed from 70 wt. % of a PVA with an Ostwald viscosity equal to 3.5 mPa·s and a molar percentage of hydrolysis equal to 87.5 measured from the ester value (DIN 53401) and 30 wt. % of a copolymer composed of 37 wt. % methacrylic acid, 54 wt. % ethyl acrylate and 9 wt. % of a precondensate of ethylene glycol methacrylate and toluene diisocyanate condensed on nonylphenol with 50 units ethylene oxide.

The product of the invention is identified as product No. 3 in the remainder of the application.

Test No. 8

A polymer composition of the invention is formed from 80 wt. % of a PVA with an Ostwald viscosity equal to 3.5 mPa·s and a molar percentage of hydrolysis equal to 87.5 measured from the ester value (DIN 5340 1) and 20 wt. % of a copolymer composed of 42 wt. % methacrylic acid, 54.1 wt. % ethyl acrylate and 0.8 wt. % n-methylolacrylamide, 1.6% ethylene glycol dimethacrylate and 1.5% acrylamide.

The product of the invention is identified as product No. 4 in the remainder of the application.

Test No.9

A polymer composition of the invention is formed from 70 wt. % of a PVA with an Ostwald viscosity equal to 3.5 mPa·s and a molar percentage of hydrolysis equal to 87.5 measured from the ester value (DIN 53401) and 30 wt. % of a copolymer composed of 37 wt. % methacrylic acid, 54 wt. % ethyl acrylate and 9 wt. % tristyrylphenol methacrylate with 25 units ethylene oxide.

The product of the invention is identified as product No. 5 in the remainder of the application.

Test No. 10

A polymer composition of the invention is formed from 70 wt. % of a PVA with an Ostwald viscosity equal to 3.5 mPa·s and a molar percentage of hydrolysis equal to 87.5 measured from the ester value (DIN 53401) and 30 wt. % of a copolymer composed of 37 wt. % methacrylic acid and 63 wt. % ethyl acrylate.

The product of the invention is identified as product No. 6 in the remainder of the application.

Test No. 11

A polymer composition of the invention is formed from 70 wt. % of a PVA with an Ostwald viscosity equal to 3.5 mPa·s and a molar percentage of hydrolysis equal to 87.5 measured from the ester value (DIN 53401) and 30 wt. % of a copolymer composed of 44 wt. % methacrylic acid, 15 wt. % butyl acrylate and 41 wt. % styrene.

The product of the invention is identified as product No. 7 in the remainder of the application.

Test No. 12

A polymer composition of the invention is formed from 70 wt. % of a PVA with an Ostwald viscosity equal to 3.5 mPa·s and a molar percentage of hydrolysis equal to 87.5 measured from the ester value (DIN 53401) and 30 wt. % of a polyurethane polycondensate of lauryl alcohol, diisocyanate and polyalkylene glycol.

The product of the invention is identified as product No. 8 in the remainder of the application.

Test No. 13

A polymer composition of the invention is formed from 70 wt. % of a PVA with an Ostwald viscosity equal to 3.5 mPa·s and a molar percentage of hydrolysis equal to 87.5 measured from the ester value (DIN 53401) and 30 wt. % of a polyurethane polycondensate of octanol, diisocyanate and polyalkylene glycol.

The product of the invention is identified as product No. 9 in the remainder of the application.

Test No. 14

A polymer composition of the invention is formed from 70 wt. % of a PVA with an Ostwald viscosity equal to 3.5 mPa–s and a molar percentage of hydrolysis equal to 87.5 measured from the ester value (DIN 53401) and 30 wt. % a homopolymer of acrylic acid in solution in completely acid form.

The product of the invention is identified as product No. 10 in the remainder of the application.

Test No. 15

A polymer composition of the invention is formed from 70 wt. % of a PVA with an Ostwald viscosity equal to 3.5 mPa–s and a molar percentage of hydrolysis equal to 87.5 measured from the ester value (DIN 53401), 15 wt. % of a copolymer composed of 37 wt. % methacrylic acid and 63 wt. % ethyl acrylate, and 15 wt. % of another copolymer composed of 44 wt. % methacrylic acid and 15 wt. % butyl acrylate and 41 wt. % styrene.

The product of the invention is identified as product No. 11 in the remainder of the application.

Test No. 16

A slurry of calcium carbonate "Hydrocarb™ CC" from Omya containing the polymer composition formed from 70 wt. % of a PVA with an Ostwald viscosity equal to 3.5 mPa·s and a molar percentage of hydrolysis equal to 87.5 measured from the ester value (DIN 53401) and 30 wt. % of a copolymer composed of 37 wt. % methacrylic acid and 63 wt. % ethyl acrylate.

The product of the invention is identified as product No. 12 in the remainder of the text.

All the coating colors thus prepared are subjected to a test for measuring the water retention by the method described below.

The coating color is subjected to a pressure of 100 psi (7 bar) in a standardized cylinder, equipped with a filter paper capable of allowing water to pass therethrough.

One value is measured:

the volume of water collected after 20 min (evaluated in mL)

The lower the volume of water collected at the end of 20 min, the better the water retention. In order to collect the water a filter press is used, "API Fluid Loss Measurement" (FIG. 1) obtained from the Baroid Company which is composed essentially of a clamp having frame (6) provided with a tightening screw (1) allowing blockage of three parts of the filter body (3). A cover equipped with an air inlet (2) is provided. The body (3) is composed of:

a base (4) with a hole pierced in it and provided with a channel by which the filtrate is spread. This base supports a 60-80 mesh metal sieve (9) on which is placed the 90-mm-diameter filter paper (8) (Whatman™ No. 50) the equivalent of which is the DurieuxBleu™ No. 3.

A cylinder (5) with internal diameter of 76.2 mm and a height of 128 mm.

A cover (2) provided with an inlet for compressed gas, for which the airtightness with the cylinder is ensured with the aid of a flat joint, of the same type as those is placed on the base.

To use the filter press, place the following in order:

(i) The joint on the base (ii) The sieve on the joints (iii) The filter paper on the sieve (iii) The second joint on the filter paper Fit the cylinder (5) and the base (3) together and lock the system with a bayonet.

Fill with coating color (approximately 480 g, up to approximately 3 cm from the top of the cylinder).

Place the cover (7) on the cylinder by inserting a joint.

Place the unit in the clamp and block with the aid of a tightening screw.

Arrange a graduated test tube under the channel.

Apply a pressure of 7 bar and simultaneously start the chronometer.

After 20 min, the volume of fluid collected in the test tube (expressed in mL) is noted.

The precision of the result obtained is +/−0.2 mL.

The direct measurement of the UV 100% whiteness of the papers coated with the coating colors, according to the TAPPI T 452 ISO 2470 standard used in this example, is conducted in the following manner.

For each test, a sheet of wood-free paper with dimensions of 21×29.7 cm with a specific weight of 41 g/m$^2$ is provided and is coated with the coating color to be tested with the aid of a laboratory coater having exchangeable moving blades marketed under the trade name Mod. KCC202™ by Erichsen.

Each sheet of paper thus coated with 14–15 g/m$^2$ of coating color, then dried in an unventilated oven marketed by Jouan for 5 min at 50° C. is then subjected to light rays having a wavelength of 457 nm to determine the brightness, by means of an Eirepho 3000 spectrophotometer from "Data Color"™.

The precision of the whiteness result obtained is +/−1.

The Brookfield viscosity is of the coating color also measured at 10 and 100 rpm at 25° C., with the aid of a Brookfield viscometer of the DV-1 type equipped with adequate mobile.

The results are presented in Tables Ia, and Ib below.

TABLE Ia

| Test No. | | Prior Art 1 | Prior Art 2 | Prior Art 3 | Prior Art 4 | Prior Art 5 | Invention 6 | Invention 7 | Invention 8 |
|---|---|---|---|---|---|---|---|---|---|
| Filler: $CaCO_3$ (in dry parts) | | 100 | 100 | 100 | 100 | 100 | 100 | 100 | 100 |
| Binder: styrene-acrylic latex (in dry parts) | | 12 | 12 | 12 | 12 | 12 | 12 | 12 | 12 |
| Retainer/activator (in dry parts) | | | | | | | | | |
| CMC | | 0.5 | 0.5 | 1 | | | | | |
| PVA | | 0.5 | | | 1 | | | | |
| PVA | | | 0.5 | | | | | | |
| Product No. 1 | | | | | | 1 | | | |
| Product No. 2 | | | | | | | 1 | | |
| Product No. 3 | | | | | | | | 1 | |
| Product No. 4 | | | | | | | | | 1 |
| Product No. 5 | | | | | | | | | |
| Product No. 6 | | | | | | | | | |
| Product No. 7 | | | | | | | | | |
| Product No. 8 | | | | | | | | | |
| Product No. 9 | | | | | | | | | |
| Product No. 10 | | | | | | | | | |
| Product No. 11 | | | | | | | | | |
| Product No. 12 | | | | | | | | | |
| Brightener (in parts as is) | | 1 | 1 | 1 | 1 | 1 | 1 | 1 | 1 |
| pH | | 8.85 | 8.8 | 8.6 | 8.5 | 8.6 | 8.4 | 8.5 | 8.6 |
| Dry extract | % | 63.8 | 63.9 | 64 | 63.9 | 63.9 | 63.6 | 64 | 63.7 |
| Brookfield | 10/rpm | 2600 | 2720 | 6500 | 270 | 11000 | 980 | 650 | 640 |
| Viscosity (cP) | 100/rpm | 480 | 530 | 1300 | 100 | 1800 | 275 | 240 | 235 |
| Water Retention | Volume in 20 min | 3.8 ml | 4.7 ml | 4.0 ml | 4.9 ml | 1.8 ml | 2.5 ml | 3.2 ml | 2.5 ml |
| Brightness R 457 nm (Data color 3000) | 100% UV | 96.9 | 96.7 | 96.5 | 96.6 | 91.2 | 96.5 | 96.6 | 97.0 |

TABLE Ib

| Test No. | | Invention 9 | Invention 10 | Invention 11 | Invention 12 | Invention 13 | Invention 14 | Invention 15 | Invention 16 |
|---|---|---|---|---|---|---|---|---|---|
| Filler: $CaCO_3$ (in dry parts) | | 100 | 100 | 100 | 100 | 100 | 100 | 100 | 100 |
| Binder: styrene-acrylic latex (in dry parts) | | 12 | 12 | 12 | 12 | 12 | 12 | 12 | 12 |
| Retainer/activator (in dry parts) | | | | | | | | | |
| CMC | | | | | | | | | |
| PVA | | | | | | | | | |
| PVA | | | | | | | | | |
| Product No. 1 | | | | | | | | | |
| Product No. 2 | | | | | | | | | |
| Product No. 3 | | | | | | | | | |
| Product No. 4 | | | | | | | | | |
| Product No. 5 | | 1 | | | | | | | |
| Product No. 6 | | | 1 | | | | | | |
| Product No. 7 | | | | 1 | | | | | |
| Product No. 8 | | | | | 1 | | | | |
| Product No. 9 | | | | | | 1 | | | |
| Product No. 10 | | | | | | | 1 | | |
| Product No. 11 | | | | | | | | 1 | |
| Product No. 12 | | | | | | | | | 1 |
| Brightener (in parts as is) | | 1 | 1 | 1 | 1 | 1 | 1 | 1 | 1 |
| pH | | 8.5 | 8.4 | 8.4 | 8.6 | 8.7 | 8.6 | 8.8 | 8.8 |
| Dry extract | % | 64 | 63.6 | 63.7 | 63.7 | 63.7 | 63.7 | 63.9 | 63.7 |
| Brookfield | 10/rpm | 1590 | 2540 | 140 | 400 | 500 | 400 | 1290 | 2630 |
| Viscosity (cP) | 100/rpm | 400 | 520 | 100 | 220 | 230 | 580 | 375 | 250 |
| Water Retention | Volume in 20 min | 2.0 ml | 2.1 ml | 3.0 ml | 3.6 ml | 4.0 ml | 4.4 ml | 2.2 ml | 3.0 ml |
| Brightness R 457 nm (Data color 3000) | 100% UV | 96.95 | 97.2 | 95.71 | 96.7 | 95.8 | 96 | 96.5 | 96.5 |

A consideration of Tables Ia and Ib shows that only the coating colors of the invention have good brightness and good retention at the same time, and this with the use of a single product of the invention instead of two as in the prior art. In fact, test No. 5 of the prior art, which only uses a single product, has good water retention but poor brightness.

Furthermore, a consideration of these Tables Ia and Ib and especially by comparison of Tests Nos. 1 and No. 12 also allows makes it evident that the coating color of the invention permits choosing the desired Brookfield viscosity while preserving the water retention and activation of the optical brighteners.

Example II

In a second group of tests (No. 17 to No. 32) the operations and measurements of Example I are repeated with the same operating method and the same material, but by replacing the 100 dry parts of calcium carbonate of Example I with 70 parts by weight of an aqueous suspension of calcium carbonate Hydrocarb™ 90ME from Omya and 30 parts by weight of the kaolin Hydragloss™ 90 from Huber.

The different tests are:

Test No. 17

This test illustrates the prior art, uses the following coating color by mixing:

100 parts, expressed as dry matter, composed of 70 parts by weight of an aqueous suspension of calcium carbonate, Hydrocarb™ 90ME from Omya and 30 parts by dry weight of kaolin Hydragloss™ 90 from Huber, 12 parts, expressed as dry matter, of a styrene-acrylic latex marketed by BASF under the name "Acronal™ S360D", 0.5 part, expressed as dry matter, of a solution of PVA marketed under the name "Mowiol™ 3/83" by Clariant, 0.5 part, expressed as dry matter, of a carboxyrmethylcellulose (CMC) marketed under the name "Finnfix™ 10" by Metsä Serla, 1 part, expressed as is, of an optical brightener marketed by Bayer under the name "Blankophor™ P"

The content of dry matter is on the order of 64% and the pH is on the order of 8–9 by adjusting the pH of the coating color with an aqueous sodium hydroxide solution.

Test No. 18

This test illustrates the prior art, uses the following coating color by mixing:

100 parts, expressed as dry matter, composed of 70 parts by dry weight of an aqueous suspension of calcium carbonate, Hydrocarb™ 90ME from Omya and 30 parts by dry weight of kaolin Hydragloss™ 90 from Huber, 12 parts, expressed as dry matter, of a styrene-acrylic latex marketed by BASF under the name "Acronal™ S360D"

0.5 part, expressed as dry matter, of a solution of PVA marketed under the name "MoWiol™ 6/98" by Clariant, 0.5 part, expressed as dry matter, of a carboxymethylcellulose (CMC) marketed under the name "Finnfix™ 10" by Metsä Serla, 1 part, expressed as is, of an optical brightener marketed by Bayer under the name "Blankophor™ P"

The content of dry matter is on the order of 64% and the pH is on the order of 8–9 by adjusting the pH of the coating color with an aqueous sodium hydroxide solution.

Test No. 19

This test illustrates the prior art and uses the following coating color by mixing:

100 parts, expressed as dry matter, composed of 70 parts of dry weight of an aqueous suspension of calcium carbonate, Hydrocarb™ 90ME from Omya and 30 parts by dry weight of kaolin Hydragloss™ 90 from Huber, 12 parts, expressed as dry matter, of a styrene-acrylic latex marketed by BASF under the name "Acronal™ S360D", 1 part, expressed as dry matter, of a carboxymethylcellulose (CMC) marketed under the name "Finnfix™ 10" by Metsä Serla, 1 part, expressed as is, of an optical brightener marketed by Bayer under the name "Blankophor™ P", The content of dry matter is on the order of 64% and the pH is on the order of 8–9 by adjusting the pH of the coating color with an aqueous sodium hydroxide solution.

Test No. 20

This test, illustrates the prior art and uses the following coating colpor by mixing:

100 parts, expressed as dry matter, composed of 70 parts by dry weight of an aqueous T" suspension of calcium carbonate, Hydrocarb 90ME from Omya and 30 parts by dry weight of kaolin Hydragloss™ 90 from Huber, 12 parts, expressed as dry matter, of a styrene-acrylic latex marketed by BASF under the name "Acronal™ S360D", 1 part, expressed as dry matter, of a solution of PVA marketed under the name "MoWiol™ 3/83" by Clariant, 1 part, expressed as is, of an optical brightener marketed by Bayer under the name "Blankophor™ P", The content of dry matter is on the order of 64% and the pH is on the order of 8–9 by adjusting the pH of the coating color with an aqueous sodium hydroxide solution.

Test No. 21

This test illustrates the prior art and uses the following coating color by mixing:

100 parts, expressed as dry matter, composed of 70 parts of an aqueous suspension of calcium carbonate, Hydrocarb 90ME from Omya and 30 parts by dry weight of kaolin Hydragloss™ 90 from Huber, 12 parts, expressed as dry matter, of a styrene-acrylic latex marketed by BASF under the name "Acronal™ S360D", 1 part, expressed as dry matter, of a copolymer dispersion known in the prior art which is formed of 37 wt. % methacrylic acid and 63 wt. % of ethyl acrylate and named Product No. 1, 1 part, expressed as is, of an optical brightener marketed by Bayer under the name "Blankophor™ P", The content of dry matter is on the order of 64% and the pH is on the order of 8–9 by adjusting the pH of the coating color with an aqueous sodium hydroxide solution.

Test No. 22

This test illustrates the invention and uses a coating color of the invention by mixing:

100 parts, expressed as dry matter, composed of 70 parts by dry weight of an aqueous suspension of calcium carbonate, Hydrocarb™ 90ME from Omya and 30 part by dry weight of kaolin Hydragloss™ 90 from Huber, 12 parts, expressed as dry matter, of a styrene-acrylic latex marketed by BASF under the name "Acronal™ S360D", 1 part, expressed in dry matter, of a polymer composition of the invention, called product No. 13, 1 part, expressed as is, of an optical brightener marketed by Bayer under the name "Blankophor™ P".

The content of dry matter is on the order of 64% and the pH is on the order of 8–9 by adjusting the pH of the slip with an aqueous sodium hydroxide solution.

A polymer composition of the invention identified as product No. 13 is formed from 70 wt. % of a PVA with an Ostwald viscosity equal to 3.5 mPa·s and a molar percentage of hydrolysis equal to 88 measured from the ester value (DIN 53401) and 30 wt. % of a copolymer composed of 37 wt. % methacrylic acid and 63 wt. % ethyl acrylate.

The product of the invention is identified as product No. 13 in the remainder of the application.

Test No. 23

This test illustrates the invention and uses a coating color of the invention by mixing the same components as in Test No. 22 except for the composition of the invention.

In this test, the polymer composition of the invention is product No. 6 of the invention.

Test No. 24

This test illustrates the invention and uses a coating color of the invention by mixing the same constituents as in Test No. 22 except for the polymer composition of the invention.

In this test, the polymer composition of the invention is formed from 70 wt. % of a PVA with an Ostwald viscosity equal to 3 mPa·s and a molar percentage of hydrolysis equal to 83 measured from the ester value (DIN 53401) and 30 wt. % of a copolymer composed of 37 wt. % methacrylic acid and 63 wt. % ethyl acrylate.

The product of the invention is identified as product No. 14.

Test No. 25

This test illustrates the invention and uses a coating color of the invention by mixing the same constituents as in Test No. 22 except for the polymer composition of the invention.

In this test, the polymer composition of the invention is formed from 70 wt. % of a PVA with an Ostwald viscosity equal to 5 mPa·s and a molar percentage of hydrolysis equal to 88 measured from the ester value (DIN 53401) and 30 wt. % of a copolymer composed of 37 wt. % methacrylic acid and 63 wt. % ethyl acrylate.

The product of the invention is identified as product No. 15.

Test No. 26

This test illustrates the invention and uses a coating color of the invention by mixing the same constituents as in Test No. 22 except for the polymer composition of the invention.

In this test, the polymer composition of the invention is formed from 70 wt. % of a PVA with an Ostwald viscosity equal to 4 mPa·s and a molar percentage of hydrolysis equal to 88 measured from the ester value (DIN 53401) and 30 wt. % of a copolymer composed of 37 wt. % methacrylic acid and 63 wt. % ethyl acrylate.

The product of the invention is identified as product No. 16.

Test No. 27

This test illustrates the invention and uses a coating color of the invention by mixing the same constituents as in Test No. 22 except for the polymer composition of the invention.

In this test, the polymer composition of the invention is formed from 70 wt. % of a PVA with an Ostwald viscosity equal to 4 mPa·s and a molar percentage of hydrolysis equal to 98 measured from the ester value (DIN 53401) and 30 wt. % of a copolymer composed of 37 wt. % methacrylic acid and 63 wt. % ethyl acrylate.

The product of the invention is identified as product No. 17.

Test No. 28

This test illustrates the invention and uses a coating color of the invention by mixing the same constituents as in Test No. 22 except for the polymer composition of the invention.

In this test, the polymer composition of the invention is formed from 70 wt. % of a PVA with an Ostwald viscosity equal to 3.5 mPa·s and a molar percentage of hydrolysis equal to 87.5 measured from the ester value (DIN 53401) and 30 wt. % of a homopolymer of acrylic acid.

The product of the invention is identified as product No. 18.

Test No. 29

This test illustrates the invention and uses a coating color of the invention by mixing the same constituents as in Test No. 22 except for the polymer composition of the invention.

In this test, the polymer composition of the invention is formed from 20 wt. % of a PVA with an Ostwald viscosity equal to 3.5 mPa·s and a molar percentage of hydrolysis equal to 87.5 measured from the ester value (DIN 53401) and 80 wt. % of a copolymer composed of 37 wt. % methacrylic acid and 63 wt. % ethyl acrylate.

The product of the invention is identified as product No. 19.

Test No. 30

This test illustrates the invention and uses a coating color of the invention by mixing the same constituents as in Test No. 22 except for the polymer composition of the invention.

In this test, the polymer composition of the invention is formed from 40 wt. % of a PVA with an Ostwald viscosity equal to 3.5 mPa·s and a molar percentage of hydrolysis equal to 87.5 measured from the ester value (DIN 5 3401) and 60 wt. % of a copolymer composed of 37 wt. % methacrylic acid and 63 wt. % ethyl acrylate.

The product of the invention is identified as product No. 20.

Test No. 31

This test illustrates the invention and uses a coating color of the invention by mixing the same constituents as in Test No. 22 except for the polymer composition of the invention.

In this test, the polymer composition of the invention is formed from 60 wt. % of a PVA with an Ostwald viscosity equal to 3.5 mPa·s and a molar percentage of hydrolysis equal to 87.5 measured from the ester value (DIN 53401) and 40 wt. % of a copolymer composed of 37 wt. % methacrylic acid and 63 wt. % ethyl acrylate.

The product of the invention is identified product No. 21.

Test No. 32

This test illustrates the invention and uses a coating color of the invention by mixing the same constituents as in Test No. 22 except for the polymer composition of the invention.

In this test, the polymer composition of the invention is formed from 70 wt. % of a PVA with an Ostwald viscosity equal to 3.5 mPa–s and a molar percentage of hydrolysis equal to 87.5 measured from the ester value (DIN 53401) and 15 wt. % of a copolymer composed of 42 wt. % methacrylic acid and 54.1 wt. % ethyl acrylate, 0.8 wt. % n-methylolacrylamide, 1.6% of ethylene glycol dimethacrylate and 1.5% acrylamide and 15 wt. % of another copolymer composed of 37 wt. % methacrylic acid and 63 wt. % of ethyl acrylate.

The product of the invention is identified as product No. 22.

The results are presented in Tables Ia and IIb below.

TABLE IIa

| Test No. | | Prior Art 17 | Prior Art 18 | Prior Art 19 | Prior Art 20 | Prior Art 21 | Invention 22 | Invention 23 | Invention 24 |
|---|---|---|---|---|---|---|---|---|---|
| Filler: $CaCO_3$ 70 parts (dry) | | 70 | 70 | 70 | 70 | 70 | 70 | 70 | 70 |
| Filler: Kaolin 30 parts (dry) | | 30 | 30 | 30 | 30 | 30 | 30 | 30 | 30 |
| Binder: styrene-acrylic latex (in dry parts) | | 12 | 12 | 12 | 12 | 12 | 12 | 12 | 12 |
| Retainer/activator (in dry parts) | | | | | | | | | |
| CMC | | 0.5 | 0.5 | 1 | | | | | |
| PVA | | 0.5 | | | 1 | | | | |
| PVA | | | 0.5 | | | | | | |
| Product No. 1 | | | | | | 1 | | | |
| Product No. 13 | | | | | | | 1 | | |
| Product No. 6 | | | | | | | | 1 | |
| Product No. 14 | | | | | | | | | 1 |
| Product No. 15 | | | | | | | | | |
| Product No. 16 | | | | | | | | | |
| Product No. 17 | | | | | | | | | |
| Product No. 18 | | | | | | | | | |
| Product No. 19 | | | | | | | | | |
| Product No. 20 | | | | | | | | | |
| Product No. 21 | | | | | | | | | |
| Product No. 22 | | | | | | | | | |
| Brightener (in parts as is) | | 1 | 1 | 1 | 1 | 1 | 1 | 1 | 1 |
| pH | | 8.6 | 8.6 | 8.5 | 8.4 | 8.1 | 8.1 | 8.2 | 8.2 |
| Dry extract | % | 63.9 | 63.7 | 63.9 | 64 | 64.2 | 63.8 | 63.9 | 63.8 |
| Brookfield | 10/rpm | 4400 | 4180 | 11600 | 410 | 18400 | 6600 | 5800 | 5920 |
| Viscosity (cP) | 100/rpm | 820 | 730 | 2100 | 150 | 3080 | 1200 | 1120 | 1150 |
| Water Retention | Volume in 20 min | 2.1 ml | 1.9 ml | 2.5 ml | 3.2 ml | 1.0 ml | 1.5 ml | 1.5 ml | 1.5 ml |
| Brightness (Data color 3000) | 100% UV | 93.1 | 93.7 | 93.2 | 93 | 87.6 | 93.0 | 93.3 | 92.6 |

TABLE IIb

| Test No. | | Invention 25 | Invention 26 | Invention 27 | Invention 28 | Invention 29 | Invention 30 | Invention 31 | Invention 32 |
|---|---|---|---|---|---|---|---|---|---|
| Filler: $CaCO_3$ 70 parts (dry) | | 70 | 70 | 70 | 70 | 70 | 70 | 70 | 70 |
| Filler: Kaolin 30 parts (dry) | | 30 | 30 | 30 | 30 | 30 | 30 | 30 | 30 |
| Binder: Styrene-acrylic latex (in dry parts) | | 12 | 12 | 12 | 12 | 12 | 12 | 12 | 12 |
| Retainer/activator (in dry parts) | | | | | | | | | |
| CMC | | | | | | | | | |
| PVA | | | | | | | | | |
| PVA | | | | | | | | | |
| Product No. 1 | | | | | | | | | |
| Product No. 13 | | | | | | | | | |
| Product No. 6 | | | | | | | | | |
| Product No. 14 | | | | | | | | | |
| Product No. 15 | | 1 | | | | | | | |
| Product No. 16 | | | 1 | | | | | | |
| Product No. 17 | | | | 1 | | | | | |
| Product No. 18 | | | | | 1 | | | | |
| Product No. 19 | | | | | | 1 | | | |
| Product No. 20 | | | | | | | 1 | | |
| Product No. 21 | | | | | | | | 1 | |
| Product No. 22 | | | | | | | | | 1 |
| Brightener (in parts as is) | | 1 | 1 | 1 | 1 | 1 | 1 | 1 | 1 |
| pH | | 8.1 | 8 | 8.0 | 8 | 8.5 | 8.6 | 8.6 | 8.3 |
| Dry extract | % | 63.9 | 63.75 | 63.7 | 64.2 | 64.1 | 64.1 | 64.1 | 63.8 |
| Brookfield | 10/rpm | 4960 | 8240 | 2620 | 3460 | 17120 | 13300 | 10600 | 7260 |
| Viscosity (cP) | 100/rpm | 95 | 1350 | 525 | 820 | 2900 | 2530 | 2170 | 1480 |
| Water Retention | Volume in 20 min | 2.8 ml | 1.6 ml | 2.6 ml | 3.0 ml | 1.2 ml | 1.5 ml | 2.6 ml | 1.8 ml |
| Brightness (Data color 3000) | 100% UV | 91.4 | 92.8 | 93.0 | 92.8 | 89.6 | 90.4 | 92.0 | 92.3 |

As in the previous example, a consideration of Tables Ia and IIb shows that only the coating colors of the invention have good brightness and good retention at the same time and this with the use of a single product of the invention instead of two as in the prior art. Likewise, a consideration of these Tables Ia and IIb allows it to be seen that the coating colors of the invention give the possibility of selecting the desired Brookfield viscosity while maintaining the water retention and activation of the optical brighteners.

The conclusion is, therefore, identical to that of the previous example but for a coating color containing calcium carbonate and kaolin as pigments.

Example III

In a third group of tests, No. 33 to No. 43, with the same operating method and the same material, the operations and measurements of Example I are repeated except that the 100 dry parts calcium carbonate of Example I is replaced with 70 parts by dry weight of an aqueous suspension of calcium carbonate Hydrocarb™ 90ME from Omya and 30 parts by dry weight of talc C10 from Mondo Minerals.

The different tests are:

Test No. 33

This test illustrates the prior art and uses the following coating color by mixing:

- 100 parts, expressed as dry matter, composed of 70 parts by dry weight of an aqueous suspension of calcium carbonate, Hydrocarb™ 90ME from Omya and 30 parts by dry weight of talc C10 from Mondo Minerals,
- 12 parts, expressed as dry matter, of a styrene-acrylic latex marketed by BASF under the name "Acronal™ S360D",
- 0.5 part, expressed as dry matter, of a solution of PVA marketed under the name "Mowiol™ 3/83" by the Clariant,
- 0.5 part, expressed as dry matter, of a carboxymethylcellulose (CMC) marketed under the name "Finnfix™ 10" by Metsä Serla,
- 1 part, expressed as is, of an optical brightener marketed by Bayer under the name "Blankophor™ P", The content of dry matter is on the order of 64% and the pH is on the order of 8–9 by adjusting the pH of the coating color with an aqueous sodium hydroxide solution.

Test No. 34

This test illustrates the prior art and uses the following coating color prepared by mixing:

- 100 parts, expressed as dry matter, composed of 70 parts of dry weight of an aqueous suspension of calcium carbonate, Hydrocarb™ 90ME from Omya and 30 parts by dry weight of talc C10 from Mondo Minerals,
- 12 parts, expressed as dry matter, of a styrene-acrylic latex marketed by BASF under the name "Acronal™ S360D",
- 0.5 part, expressed as dry matter, of a solution of PVA marketed under the name "MoWiol™ 6/98" by Clariant,
- 0.5 part, expressed as dry matter, of a carboxymethylcellulose (CMC) marketed under the name "Finnfix™ 10" by Metsä Serla,
- 1 part, expressed as is, of an optical brightener marketed by Bayer under the name "Blankophor™ P".

The content of dry matter is on the order of 64% and the pH is on the order of 8–9 by adjusting the pH of the coating color with an aqueous sodium hydroxide solution.

Test No. 35

This test illustrates the prior art and uses the following coating color prepared by mixing:

- 100 parts, expressed as dry matter, composed of 70 parts by dry weight of an aqueous suspension of calcium carbonate, Hydrocarb™ 90ME from Omya and 30 parts by dry weight of talc C10 from Mondo Minerals, 12 parts, expressed as dry matter, of a styrene-acrylic latex marketed by BASF under the name "Acronal™ S360D", 1 part, expressed as dry matter, of a carboxymethylcellulose (CMC) marketed under the name "Finnfix™ 10" by Metsä Serla, 1 part, expressed as is, of an optical brightener marketed by Bayer under the name "Blankophor™ P", The content of dry matter is on the order of 64% and the pH is on the order of 8–9 by adjusting the pH of the coating color with an aqueous sodium hydroxide solution.

Test No. 36

This test illustrates the prior art and uses the following coating color prepared by mixing:

100 parts, expressed as dry matter, composed of 70 parts of an aqueous suspension of calcium carbonate, Hydrocarb™ 90ME from Omya and 30 parts by dry weight of talc C10 from Mondo Minerals, 12 parts, expressed as dry matter, of a styrene-acrylic latex marketed by BASF under the name "Acronal™ S360D", 1 part, expressed as dry matter, of a solution of PVA marketed under the name "MoWiol™ 3/83" by Clariant, 1 part, expressed as is, of an optical brightener marketed by Bayer under the name "Blankophor™ P", The content of dry matter is on the order of 64% and the pH is on the order of 8–9 by adjusting the pH of the coating color with an aqueous sodium hydroxide solution.

Test No. 37

This test illustrates the prior art and uses the following coating color:

100 parts, expressed as dry matter, of 70 parts by dry weight of an aqueous suspension of calcium carbonate, Hydrocarb™ 90ME from Omya and 30 parts by dry weight of talc C10 from Mondo Minerals, 12 parts, expressed as dry matter, of a styrene-acrylic latex marketed by BASF under the name "Acronal™ S360D", 1 part, expressed in dry matter, of a copolymer of the prior art formed from 37 wt. % methacrylic acid and 63 wt. % ethyl acrylate and called Product No. 1, 1 part, expressed as is, of an optical brightener marketed by Bayer under the name Blankophor™ P", The content of dry matter is on the order of 64% and the pH is on the order of 8–9 by adjusting the pH of the coating color with an aqueous sodium hydroxide solution.

Test No. 38

This test illustrates the invention and uses a coating color of the invention by mixing:

100 parts, expressed as dry matter, of 70 parts by dry weight of an aqueous suspension of calcium carbonate, Hydrocarb™ 90ME from Omya and 30 parts by dry weight of talc C10 from Mondo Minerals, 12 parts, expressed as dry matter, of a styrene-acrylic latex marketed by BASF under the name "Acronal™ S360D", 1 part, expressed in dry matter, of a polymer composition of the invention, called Product No. 2, 1 part, expressed as is, of an optical brightener marketed by Bayer under the name "Blankophor™ P", The content of dry matter is on the order of 64% and the pH is on the order of 8–9 by adjusting the pH to the coating color with an aqueous sodium hydroxide solution.

Test. No. 39

This test illustrates the invention and uses a coating color of the invention by mixing the same components as in Test No. 38 except for the polymer composition of the invention.

In this test, the polymer composition used of the invention is Product No. 3 of the invention.

Test No. 40

This test illustrates the invention and uses a coating color of the invention by mixing the same components as in Test No. 38 except for the polymer composition of the invention.

In this test, the polymer composition used of the invention is Product No. 4 of the invention.

Test No. 41

This test illustrates the invention and uses a coating color of the invention by mixing the same components as in Test No. 38 except for the polymer composition of the invention.

In this test the polymer composition used the invention is Product No, 5 of the invention.

Test No. 42

This test illustrates the invention and uses a coating color of the invention by mixing the same components as in Test No. 38 except for the polymer composition of the invention.

In this test, the polymer composition used of the invention is Product No. 6 of the invention.

Test No. 43

This test illustrates the invention and uses a coating color of the invention by mixing the same components as in Test No. 38 except for the polymer composition of the invention, In this test, the polymer composition used of the invention is Product No. 7 of the invention.

The results are presented in Tables IIIa and IIIb below.

TABLE IIIa

| Test No. | Previous Art 33 | Previous Art 34 | Previous Art 35 | Previous Art 36 | Previous Art 37 | Invention 38 |
|---|---|---|---|---|---|---|
| Filler: $CaCO_3$ (in dry parts) | 70 | 70 | 70 | 70 | 70 | 7- |
| Filler: Talc (in dry parts) | 30 | 30 | 30 | 30 | 30 | 30 |
| Binder: Styrene-acrylic latex (in dry parts) | 12 | 12 | 12 | 12 | 12 | 12 |
| Retainer/activator (in dry parts) | | | | | | |
| CMC | 0.5 | 0.5 | 1 | | | |
| PVA | 0.5 | | | 1 | | |
| PVA | | 0.5 | | | | |
| Product No. 1 | | | | | 1 | |
| Product No. 2 | | | | | | 1 |
| Product No. 3 | | | | | | |
| Product No. 4 | | | | | | |
| Product No. 5 | | | | | | |
| Product No. 6 | | | | | | |

TABLE IIIa-continued

| Test No. | | Previous Art 33 | Previous Art 34 | Previous Art 35 | Previous Art 36 | Previous Art 37 | Invention 38 |
|---|---|---|---|---|---|---|---|
| Product No. 7 | | | | 1 | 1 | 1 | |
| Brightener (in parts as is) | | 1 | 1 | | | | |
| pH | | 8.5 | 8.6 | 8.5 | 8.6 | 8.4 | 8.3 |
| Dry extract | % | 64.3 | 64.0 | 63.8 | 63.9 | 63.8 | 63.7 |
| Brookfield | 10 rpm | 7120 | 5400 | 14600 | 550 | 21000 | 2000 |
| viscosity (cP) | 100 rpm | 1070 | 1020 | 2500 | 210 | 3400 | 550 |
| Water retention | Volume in 20 min. | 1.9 ml | 1.4 ml | 2.3 ml | 3.0 ml | 0.8 ml | 1 ml |
| Brightness R 457 nm (Data color 3000) | 100% UV | 92.7 | 94.2 | 93.0 | 92.9 | 87.2 | 93.0 |

TABLE IIIb

| Test No. | | Invention 39 | Invention 40 | Invention 41 | Invention 42 | Invention 43 |
|---|---|---|---|---|---|---|
| Filler: $CaCO_3$ (in dry parts) | | 70 | 70 | 70 | 70 | 70 |
| Filler: Talc (in dry parts) | | 30 | 30 | 30 | 30 | 30 |
| Binder: Styrene-acrylic latex (in dry parts) | | 12 | 12 | 12 | 12 | 12 |
| Retainer/activator (in dry parts) | | | | | | |
| CMC | | | | | | |
| PVA | | | | | | |
| PVA | | | | | | |
| Product No. 1 | | | | | | |
| Product No. 2 | | | | | | |
| Product No. 3 | | 1 | | | | |
| Product No. 4 | | | 1 | | | |
| Product No. 5 | | | | 1 | | |
| Product No. 6 | | | | | 1 | |
| Product No. 7 | | | | | | 1 |
| Brightener (in parts as is) | | 1 | 1 | 1 | 1 | 1 |
| pH | | 8.4 | 8.5 | 8.6 | 8.6 | 8.6 |
| Dry Extract | % | 64.3 | 63.9 | 63.7 | 63.8 | 63.9 |
| Brookfield viscosity (cP) | ron | 4240 | 1640 | 2920 | 5040 | 450 |
| | | 1070 | 460 | 700 | 1060 | 190 |
| Water retention | Volume in 20 min | 1.7 ml | 1.3 ml | 0.9 ml | 1.4 ml | 2.1 ml |
| Whiteness R 457 nm (Data color 3000) | 100% UV | 93.3 | 93.2 | 93.1 | 93.2 | 92.2 |

A consideration of Tables IIIa and IIIb allows the same conclusions to be reached as those from Table I or II, but this time for a coating color containing a filler composed of calcium carbonate and talc.

Examples 34 and 42 may be differentiated by the use of a single product for Test No. 42 of the invention while two products were used in Test No. 34 of the prior art.

Example IV

This example concerns the tests on variations in the type of optical brightener.

With this goal, the coating colors are prepared for testing by mixing:

- 70 parts, expressed as dry matter, of an aqueous suspension of calcium carbonate Hydrocarb™ 90ME from Omya,
- 30 parts, expressed as dry matter, of kaolin Hydragloss™ go from Huber,
- 12 parts, expressed as dry matter, of a styrene-acrylic latex marketed under the name Acronal™ S360D by BASF,
- 1 part, expressed as dry matter, of product No. 6 of the invention
- 1 part, expressed as is, of the different optical brighteners to be tested, except for Test No. 44 which constitutes a control test in which no optical brightener was used.

The content of dry matter was on the order of 64% and the pH was kept from 8 to 9 with an aqueous sodium hydroxide solution.

The different optical brighteners are:

Test No. 45

Optical brightener sold by Bayer under the name Blankophor™ P.

Test No. 46

Optical brightener sold by Clariant under the name Leucophor™ CK.

Test No. 47

Optical brightener sold by Bayer under the name Blankopho™ PSK.

Test No. 48

Optical brightener sold by 3V Sigma under the name Optiblanc™.

Test No. 49

Optical brightener sold by Ciba under the name Tinopal™ ABP.

Test No. 50

Optical brightener sold by Ciba under the name Tinopal™ STP.

Test No. 51

Optical brightener sold by Ciba under the name Tinopal™ SPP.

Test No. 52

Optical brightener sold by Ciba under the name Tinopal™ UP.

Test No. 53

Optical brightener sold by Ciba under the name Tinopal™ SK.

These different coating colors of the invention are then used to determine measurements of viscosity, water retention and brightness by the same operating methods as for the previous tests.

The results are presented in the following Tables IVa and IVb.

TABLE IVa

| Test No. | | Control 44 | Invention 45 | Invention 46 | Invention 47 | Invention 48 | Invention 49 |
|---|---|---|---|---|---|---|---|
| Filler: $CaCO_3$ (in dry parts) | | 70 | 70 | 70 | 70 | 70 | 70 |
| Filler: kaolin (in dry parts) | | 30 | 30 | 30 | 30 | 30 | 30 |
| Binder: styrene-acrylic latex (in dry parts) | | 12 | 12 | 12 | 12 | 12 | 12 |
| Retainer/activator (in dry parts) | | | | | | | |
| Product No. 6 | | 1 | 1 | 1 | 1 | 1 | 1 |
| Brightener (in parts as is) | | 0 | | | | | |
| Blankophor P | | | 1 | | | | |
| Leucophor CK | | | | 1 | | | |
| Blankophor PSK | | | | | 1 | | |
| Optiblanc | | | | | | 1 | |
| Tinopal ABP | | | | | | | 1 |
| Tinopal STP | | | | | | | |
| Tinopal SPP | | | | | | | |
| Tinopal UP | | | | | | | |
| Tinopal SK | | | | | | | |
| pH | | 8.9 | 8.5 | 8.6 | 8.8 | 8.6 | 8.5 |
| Dry extract | % | 64 | 63.9 | 64.0 | 63.8 | 64.0 | 64.1 |
| Brookfield | 10 rpm | 8600 | 8000 | 8800 | 8450 | 6880 | 8600 |
| viscosity (cP) | 100 rpm | 1380 | 1470 | 1650 | 1590 | 1280 | 1510 |
| Water retention | Volume in 20 min. | 1.6 ml | 1.5 ml | 1.6 ml | 1.7 ml | 1.6 ml | 1.5 ml |
| Brightness R 457 nm (Data color 3000) | 100% UV | 82.2 | 92.4 | 92.5 | 91.6 | 92.8 | 92.8 |

TABLE IVb

| Test No. | | Invention 50 | Invention 51 | Invention 52 | Invention 53 |
|---|---|---|---|---|---|
| Filler: $CaCO_3$ (in dry parts) | | 70 | 70 | 70 | 70 |
| Filler: kaolin (in dry parts) | | 30 | 30 | 30 | 30 |
| Binder: styrene-acrylic latex (in dry parts) | | 12 | 12 | 12 | 12 |
| Retainer/activator (in dry parts) | | | | | |
| Product No. 6 | | 1 | 1 | 1 | 1 |
| Brightener (in parts as is) | | | | | |
| Blankophor P | | | | | |
| Leucophor CK | | | | | |
| Blankophor PSK | | | | | |
| Optiblanc | | | | | |
| Tinopal ABP | | | | | |
| Tinopal STP | | 1 | | | |
| Tinopal SPP | | | 1 | | |
| Tinopal UP | | | | 1 | |
| Tinopal SK | | | | | 1 |
| pH | | 8.7 | 8.8 | 8.5 | 8.6 |
| Dry extract | % | 63.8 | 64.1 | 64.0 | 63.9 |
| Brookfield viscosity | 10 rpm | 8800 | 8200 | 7300 | 10000 |
| (cP) | 100 rpm | 1620 | 1520 | 1260 | 1820 |
| Water retention | Volume in 20 min. | 1.6 ml | 1.7 ml | 1.5 ml | 1.6 ml |
| Brightness R 457 nm (Data color 3000) | 100% UV | 90.2 | 91.1 | 95.9 | 99.5 |

Reading of Tables IVa and IVb permits it to be noted that whatever the optical brightener used, the polymer composition of the invention enables an increase in the brightness under UV while keeping the water retention.

Example V

In this example which illustrates the invention, the proportion of polymer composition varies in relation to the amount of optical brightener employed in the coating color.

With this goal, the coating colors are prepared to be tested according to the same method of operation, with the same material and the same amounts of the different components as in the previous example, except for the amounts of optical brightener and polymer composition of the invention which vary in the various different tests.

Test No. 54

This test, which illustrates the invention, employed 0.6 part, expressed as is, of the optical brightener sold by Ciba under the name Tinopal™ 14 ABP and 0.6 part of product No. 6 of the invention.

Test No. 5

This test, which illustrates the invention, employed 0.6 part, expressed as is, of the optical brightener sold by Ciba under the name Tinopal™ ABP and 0.8 part of product No. 6 of the invention.

Test No. 56

This test, which illustrates the invention, used 0.6 part, expressed as is, of the optical brightener sold by Ciba under the name Tinopal™ ABP and 1.0 part of product No. 6 of the invention.

Test No. 57

This test, which illustrates the invention, employed 0.6 part, expressed as is, of the optical brightener sold by Ciba under the name Tinopal™ ABP and 1.2 parts of product No. 6 of the invention.

Test No. 58

This test, which illustrates the invention, employed 0.8 part, expressed as is, of the optical brightener sold by Ciba under the name Tinopal™ ABP and 0.6 part of product No. 6 of the invention.

Test No. 59

This test, which illustrates the invention, employed 0.8 part, expressed as is, of the optical brightener sold by Ciba under the name Tinopal™ ABP and 0.8 part of product No. 6 of the invention.

Test No. 60

This test, which illustrates the invention, employed 0.8 part, expressed as is, of the optical brightener sold by Ciba under the name Tinopal™ ABP and 1.0 part of product No. 6 of the invention.

Test No. 61

This test, which illustrates the invention, employed 0.8 part, expressed as is, of the optical brightener sold by Ciba under the name Tinopal™ ABP and 1.2 parts of product No. 6 of the invention.

Test No. 62

This test, which illustrates the invention, employed 1.0 part, expressed as is, of the optical brightener sold by Ciba under the name Tinopal™ ABP and 0.6 part of product No. 6 of the invention.

Test No.63

This test, which illustrates the invention, employed 1.0 part, expressed as is, of the optical brightener sold by Ciba under the name Tinopal™ ABP and 0.8 part of product No. 6 of the invention.

Test No. 64

This test, which illustrates the invention, employed 1.0 part, expressed as is, of the optical brightener sold by Ciba under the name Tinopal™ ABP and 1.0 part of product No. 6 of the invention.

Test No. 65

This test, which illustrates the invention, employed 1.0 part, expressed as is, of the optical brightener sold by Ciba under the name Tinopal™ ABP and 1.2 parts of product No. 6 of the invention.

Test No. 66

This test, which illustrates the invention used 1.2 parts, expressed as is, of the optical brightener sold by Ciba under the name Tinopal™ ABP and 0.6 part of product No. 6 of the invention.

Test No. 67

This test, which illustrates the invention, employed 1.2 parts, expressed as is, of the optical brightener sold by Ciba under the name Tinopal™ ABP and 0.8 part of product No. 6 of the invention.

Test No. 68

This test, which illustrates the invention used 1.2 parts, expressed as is, of the optical brightener sold by Ciba under the name Tinopal™ ABP and 1.0 part of product No. 6 of the invention.

Test No. 69

This test, which illustrates the invention, employed 1.2 parts, expressed as is, of the optical brightener sold by Ciba under the name Tinopal™ ABP and 1.2 parts of product No. 6 of the invention.

The results are presented in Tables Va and Vb below.

TABLE Va

| Test No. | | 54 | 55 | 56 | 57 | 58 | 59 | 60 | 61 | 62 | 63 |
|---|---|---|---|---|---|---|---|---|---|---|---|
| Filler: $CaCO_3$ (in dry parts) | | 70 | 70 | 70 | 70 | 70 | 70 | 70 | 70 | 70 | 70 |
| Filler: Kaolin (in dry parts) | | 30 | 30 | 30 | 30 | 30 | 30 | 30 | 30 | 30 | 30 |
| Binder: styrene-acrylic latex (in dry parts) | | 12 | 12 | 12 | 12 | 12 | 12 | 12 | 12 | 12 | 12 |
| Retainer/activator (in dry parts) | | | | | | | | | | | |
| Product No. 6 | | 0.6 | 0.8 | 1.0 | 1.2 | 0.6 | 0.8 | 1.0 | 1.2 | 0.6 | 0.8 |
| Brightener (in parts as is) | | 0.6 | 0.6 | 0.6 | 0.6 | 0.8 | 0.8 | 0.8 | 0.8 | 1.0 | 1.0 |
| pH | | 8.6 | 8.7 | 8.5 | 8.5 | 8.7 | 8.6 | 8.7 | 8.5 | 8.6 | 8.7 |
| Dry Extract | % | 63.9 | 64.0 | 64.1 | 84.0 | 63.9 | 64.8 | 64.0 | 64.0 | 63.9 | 64.0 |
| Brookfield viscosity (cP) | 10 rpm | 4240 | 2120 | 3640 | 5600 | 4000 | 1960 | 4280 | 5200 | 3760 | 2040 |
| | 100 rpm | 790 | 650 | 930 | 1220 | 700 | 550 | 1000 | 1200 | 710 | 630 |
| Water retention | Volume in 20 min | 2.5 | 2.4 | 2.1 | 1.8 | 2.6 | 2.2 | 2.1 | 1.9 | 2.5 | 2.3 |
| Brightness R 457 nm (Data color 3000) | With UV | 87.2 | 88.2 | 88.5 | 88.8 | 88.4 | 89.0 | 89.3 | 89.6 | 89.2 | 89.3 |

TABLE Vb

| Test No. | | 64 | 65 | 66 | 67 | 68 | 69 |
|---|---|---|---|---|---|---|---|
| Filler: $CaCO_3$ (in dry parts) | | 70 | 70 | 70 | 70 | 70 | 70 |
| Filler: Kaolin (in dry parts) | | 30 | 30 | 30 | 30 | 30 | 30 |
| Binder: styrene-acrylic latex (in dry parts) | | 12 | 12 | 12 | 12 | 12 | 12 |
| Retainer/activator (in dry parts) | | 1.0 | 1.2 | 0.6 | 0.8 | 1.0 | 1.2 |
| Product No. 6 | | | | | | | |
| Brightener (in parts as is) | | 1.0 | 1.0 | 1.2 | 1.2 | 1.2 | 1.2 |
| pH | | 8.5 | 8.6 | 8.6 | 8.5 | 8.6 | 8.7 |
| Dry Extract | % | 63.8 | 64.0 | 53.9 | 63.8 | 64.0 | 64.0 |
| Brookfield | 10 rpm | 3920 | 4920 | 3840 | 1920 | 4080 | 4600 |
| viscosity (cP) | 100 rpm | 960 | 1150 | 720 | 610 | 910 | 1130 |
| Water retention | Volume in 20 min | 2.1 | 1.9 | 2.6 | 2.4 | 2.1 | 2 |
| Brightness R 457 nm (Data color 3000) | With UV | 89.6 | 89.9 | 89.3 | 89.5 | 90.1 | 90.4 |

A consideration of Tables Va and Vb shows that whatever the quantity of optical brightener used, the polymer composition of the invention enables the brightness under UV radiation to increase while preserving water retention.

Example VI

The nature of the binder is varied in this example which illustrates the invention.

In view of this goal, coating colors are prepared by the same operating method, the same material and the same amounts of the various components as described in Example IV except for the nature of the latex used in the various tests, as well as the products intended to function as water retainers and/or optical brightener activators.

Test No. 70

In this test, which describes the prior art, 0.5 part, expressed as dry matter, of a solution of PVA marketed under the name "Mowiol™ 3/83" by Clariant and 0.5 part, expressed as dry matter, of CMC, as well as 12 parts, expressed as dry matter, of a styrene-acrylic latex marketed under the name "Acronal™ S360D by BASF are successively combined.

Test No. 71

This test, which describes the invention, employs 1.0 part, expressed as dry matter, of product No. 6 of the invention, as well as 12 parts, expressed as dry matter, of a styrene-acrylic latex marketed under the name "Acronal™ S360D by BASF.

Test No. 72

In this test, which describes the prior art, 0.5 part, expressed as dry matter, of a solution of PVA marketed under the name "Mowiol™ 3/83" by Clariant and 0.5 part, expressed as dry matter, of CMC, as well as 12 parts, expressed as dry matter, of a styrene-butadiene latex marketed under the name DL 980 by Dow Chemical and referenced here under the name styrene-butadiene 1, are successively combined.

Test No. 73

This test, which describes the invention, employs 1 part, expressed as dry matter, of product No. 6 of the invention, as well as 12 parts, expressed as dry matter, of a styrene-butadiene latex marketed under the name DL 980 by Dow Chemical and referenced here under the name styrene-butadiene 1.

Test No. 74

This test, which describes the prior art, employs successive addition of 0.5 part, expressed as dry matter, of a solution of PVA marketed under the name "Mowiol™ 3/83" by Clariant and 0.5 part, expressed as dry matter, of CMC, as well as 12 parts, expressed as dry matter, of a styrene-butadiene latex marketed under the name Rhodopas™ SB 123 by Rhone-Poulenc and referenced here under the name styrene-butadiene 2.

Test No. 75

This test, which describes the invention, employs 1 part, expressed as dry matter, of a product No. 6 of the invention, as well as 12 parts, expressed as dry matter, of a styrene-butadiene latex marketed under the name Rhodopas™ SB 123 by Rhone-Poulenc and referenced here under the name styrene-butadiene 2.

The results are presented in the following Table VI.

TABLE VI

| Test No. | | Prior art 70 | Invention 71 | Prior art 72 | Invention 73 | Prior art 74 | Invention 75 |
|---|---|---|---|---|---|---|---|
| Filler: $CaCO_3$ (in dry parts) | | 70 | 70 | 70 | 70 | 70 | 70 |
| Filler: Kaoline (in dry parts) | | 30 | 30 | 30 | 30 | 30 | 30 |
| Binder: Latex (in dry parts) | | | | | | | |
| Acrylic styrene | | 12 | 12 | | | | |
| Styrene butadiene 1 | | | | 12 | 12 | | |
| Styrene butadiene 2 | | | | | | 12 | 12 |
| Retainer/activator (in dry parts) | | | | | | | |
| CMC | | 0.5 | | 0.5 | | 0.5 | |
| PVA | | 0.5 | | 0.5 | | 0.5 | |
| Product No. 6 | | | 1 | | 1 | | 1 |
| Brightener (in parts as is) | | 1 | 1 | 1 | 1 | 1 | 1 |
| pH | | 8.6 | 8.7 | 8.7 | 8.5 | 8.5 | 8.6 |
| Dry Extract | % | 64.1 | 64.1 | 64.1 | 64.2 | 64 | 64 |
| Brookfield viscosity (cP) | 10 rpm | 5560 | 6240 | 8080 | 6200 | 11320 | 7600 |
| | | 1000 | 1100 | 1340 | 1160 | 1620 | 1600 |
| Water retention | Volume in 20 min in mL | 2.5 | 1.6 | 5.5 | 2.5 | 2.9 | 2.5 |
| Brightness R457 nm (Data color 3000) | 100% UV | 92.3 | 92.9 | 89.4 | 90.5 | 91.9 | 91.9 |

A consideration of Table VI shows that it is possible to increase the brightness under UV radiation while preserving water retention, whichever latex is used in the coating color.

The invention is also directed to the use of stable aqueous liquid polymer compositions in the preparation of paper-making coating colors ensuring the function of activating optical brighteners, of retaining water and of controlling the viscosity of coating colors, containing at least one polyvinyl alcohol (PVA) and at least one water-soluble polymer at neutral or alkaline pH.

The invention also concerns paper coating colors of the type containing a filler, a polymer binder, water retainers, pigments, optical brighteners, and various other paper additives, and appropriate mixtures of these additives according to the knowledge of one of skilled in the art, wherein water retention, the activation of optical brighteners and the viscosities are controlled by a stable aqueous liquid polymer composition containing at least one polyvinyl alcohol (PVA) and at least one water-soluble polymer at neutral or alkaline pH.

The disclosure of French priority Application No. 98-14299 filed Nov. 10, 1998 is hereby incorporated by reference into the present application.

Obviously, numerous modifications and variations of the present invention are possible in light of the above teachings. It is, therefore, to be understood that within the scope of the appended claims, the invention may be practiced otherwise than as specifically described herein.

What is claimed as new and is intended to be secured by Letters Patent is:

1. A stable aqueous liquid polymer composition, which comprises water, and (i) at least one polyvinyl alcohol (PVA) which has an Ostwald viscosity less than 5 mPa·s corresponding to a degree of polymerization less than 600 and a molar percentage of hydrolysis ranging from 70 to 100 measured from the ester value (DIN 53401), corresponding to a molar percentage of vinyl acetate units from 30 to 0, and (ii) at least one water-soluble polymer;

wherein the water-soluble polymer is a homopolymer or copolymer of carboxylic acid in completely acid form in the aqueous liquid.

2. The stable aqueous liquid polymer composition according to claim 1, wherein said PVA has:

an Ostwald viscosity ranging from 2 mPa·s to 4 mPa·s corresponding to a degree of polymerization of 250–500 and a molar percentage of hydrolysis ranging from 80 to 90 measured from the ester value (DIN 53401) corresponding to a molar percentage of vinyl acetate units ranging from 20 to 10.

3. The stable aqueous liquid polymer composition according to claim 1, wherein the PVA content of the composition is greater than 20 wt. %.

4. The stable aqueous liquid polymer composition according to claim 1, wherein the water-soluble polymer is a copolymer in dispersion containing more than 20 wt. % of a monomer containing acid groups.

5. The stable aqueous liquid polymer composition according to claim 4, wherein the amount of monomer containing acid groups present in the water-soluble polymer copolymer is 20 to 75 wt. %.

6. The stable aqueous liquid polymer composition according to claim 4, wherein said acid groups are carboxylic acid groups.

7. The stable aqueous liquid polymer composition according to claim 4, wherein the copolymer, as an emulsion, is comprised of at least one monomer having an acid functional group selected from the group consisting of acrylic acid, methacrylic acid, itaconic acid, citraconic acid, crotonic acid, fumaric acid, maleic acid, isocrotonic acid, mesaconic acid, sinapic acid, undecylenic acid, angelic acid, their respective anhydrides, the hemiesters of said diacids, acrylamidomethylpropanesulfonic acid, the acid phosphates or sulfates of acrylates and methacrylates of ethylene glycol, propylene glycol, butylene glycol, polyethylene glycol, polypropylene glycol and polybutylene glycol with at least one of the said monomers not having an acid group selected from the group consisting of the derivatives of the above-mentioned acids and consisting of acrylonitrile, methacrylonitrile, acrylamide, methacrylamide, n-methylolacrylamide, vinyl acetate, styrene, methylstyrene, diisobutylene, divinylbenzene, methylvinyl ether, vinylcaprolactone and their mixtures, oxyalkylated monomers having ethylenic unsaturation terminated by a straight-chain or branched chain alkyl, aryl, alkylaryl or arylalkyl group with 1–50 carbon atoms, and at least one monomer having at least two ethylenic sites of unsaturation selected from the group consisting of ethylene glycol dimethyacrylate, trimethylolpropane triacrylate, allyl acrylate, methylenebisacrylamide, methylenebismethacrylamide, tetrallyloxyethane, triallylcyanurate and allyl ethers prepared from pentaerythritol, sorbitol, sucrose and their mixtures.

8. The stable aqueous liquid polymer composition according to claim 7, wherein said monomer not having an acid group is methyl (meth)acrylate, ethyl (meth)acrylate, butyl (meth)acrylate or 2-ethylhexyl (meth)acrylate.

9. The stable aqueous liquid polymer composition according to claim 7, wherein the oxyalkylated monomers having ethylenic unsaturation is terminated by a di-, tri- or tetrastyrylphenol or nonylphenol group.

10. An aqueous suspension or slurry of inorganic filler comprising the stable aqueous liquid polymer composition of claim 1.

11. The aqueous suspension or slurry of claim 10, wherein the inorganic filler is a natural calcium carbonate selected from the group consisting of chalk, calcite and marble, a synthetic calcium carbonate, a dolomite, a kaolin, talc, titanium dioxide, satin white, mica, calcined clay, aluminum hydroxide, calcium sulfate and combinations thereof.

12. A method of preparing the paper coating colors, comprising:

formulating the coating color with the stable aqueous liquid polymer composition of claim 1.

13. A method of preparing the paper coating colors, comprising:

formulating the coating color with the stable aqueous liquid polymer composition of claim 1 and an inorganic filler.

14. A paper coating color comprising the aqueous liquid polymer composition according to claim 1.

15. A paper coating color comprising the aqueous liquid polymer composition according to claim 1 and an inorganic filler.

16. A sheet of coated paper containing the paper coating color according to claim 14.

17. A sheet of coated paper containing the paper coating color according to claim 15.

* * * * *